US005711658A

United States Patent [19]

Conti et al.

[11] Patent Number: 5,711,658

[45] Date of Patent: Jan. 27, 1998

[54] DIAPHRAGM PUMP WITH IMPROVED FLOW MANIFOLDS

[75] Inventors: Michael Conti; Gerald M. Distel, both of Bryan, Ohio

[73] Assignee: Ingersoll-Rand Company, Woodcliff Lake, N.J.

[21] Appl. No.: 759,919

[22] Filed: Dec. 4, 1996

[51] Int. Cl.[6] ..... F04B 17/00

[52] U.S. Cl. ..... 417/393; 417/395; 417/344; 417/345

[58] Field of Search ..... 417/393, 395, 417/344, 345, 401, 442

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| D. 331,412 | 12/1992 | Wilden | D15/7 |
| D. 370,488 | 6/1996 | Kozumplik, Jr. | D15/7 |
| 2,679,209 | 5/1954 | Fischer et al. | 103/150 |
| 3,791,768 | 2/1974 | Wanner | 417/393 |
| 4,329,123 | 5/1982 | Kawabata et al. | 417/393 |
| 4,597,721 | 7/1986 | Santefort | 417/393 |
| 4,895,494 | 1/1990 | Gardner | 417/393 |
| 5,368,452 | 11/1994 | Johnson et al. | 417/395 |

OTHER PUBLICATIONS

Aro Air Operated Diaphragm Pumps, Form 9333–P, copyright 1993.

*Primary Examiner*—Timothy Thorpe
*Assistant Examiner*—Cheryl J. Tyler
*Attorney, Agent, or Firm*—Michael M. Gnibus

[57] ABSTRACT

A diaphragm pump including a pump housing having a first housing side and a second housing side; a first unitary manifold flow connected to the first housing side; a second unitary manifold flow connected to the second housing side. The first and second unitary manifolds are adapted to be flow connected to either the first or second housing sides. The diaphragm pump also includes a pump inlet manifold and a pump discharge manifold. The pump inlet and discharge manifolds each have a first end, a second end, a first flow port at one of the ends and a second flow port located along the manifold between the two manifold ends. Both of said manifolds are adapted to be flow connected to the first and second unitary manifolds.

8 Claims, 7 Drawing Sheets

DIAPHRAGM PUMP WITH IMPROVED FLOW MANIFOLDS

BACKGROUND OF THE INVENTION

The invention relates to a diaphragm pump and more particularly to a diaphragm pump with improved inlet and discharge manifolds provided with at least two flow ports and improved unitary side manifolds adapted to be flow connected to either side of the pump housing.

Diaphragm pumps include inlet and discharge manifolds which are flow connected to side manifolds to provide a flow path for the fluid conveyed by the diaphragm pump. Flap or ball type check valves are typically used to check the flow of fluid through the pump.

There are a number of limitations associated with conventional diaphragm pumps. First, assembly of conventional diaphragm pumps can be quite difficult and time consuming. Conventional diaphragm pumps are comprised of a large number of discrete parts. For example, four separate side manifolds are used in conventional flap valve type diaphragm pumps. Two of the side manifolds are used to flow connect the inlet manifold with the pump housing and two of the side manifolds are used to flow connect the discharge manifold with the pump housing. The side manifolds are designed to be flow connected to the pump housing at a single location along the housing. Therefore, the person assembling the diaphragm pump must remember the precise location of each of the many discrete component parts and fasteners in order to correctly assemble conventional diaphragm pumps. The large number of discrete parts and lack of flexibility in the assembly operation increases the time it takes to assemble conventional diaphragm pumps, and in turn can significantly increase the cost to manufacture the pump.

A second limitation associated with conventional diaphragm pumps is that once a pump is built and configured, the operator is limited to flow in a single direction. For example, fluid may be supplied to the pump through an inlet manifold along the top of the pump and may be discharged from the pump out a discharge manifold at the bottom of the pump. Once the pump is built, this flow configuration cannot be reversed so that fluid is supplied fluid through the manifold at the bottom of the pump, and discharged the through the manifold at the top of the pump. As a result, making the required flow connections between the pump and existing plumbing is frequently difficult.

A third limitation associated with conventional diaphragm pumps is that the inlet and discharge manifolds include only a single port located at approximately the middle of the inlet and discharge manifolds between the ends of the manifold. Existing plumbing is then flow connected to the centrally located port. Providing only a single port along the manifold length can limit the ability to simply make required flow connections with existing supply lines.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a diaphragm pump comprising a pump housing having a first housing side and a second housing side; a first unitary manifold flow connected to the first housing side; a second unitary manifold flow connected to the second housing side. The first and second unitary manifolds are adapted to be flow connected to either the first or second housing sides. The diaphragm pump also includes a pump inlet manifold and a pump discharge manifold. The pump inlet and discharge manifolds each have a first end, a second end, a first flow port at one of the ends and a second flow port located along the manifold between the two manifold ends. Both of said manifolds are adapted to be flow connected to the first and second unitary manifolds.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Figure 1:
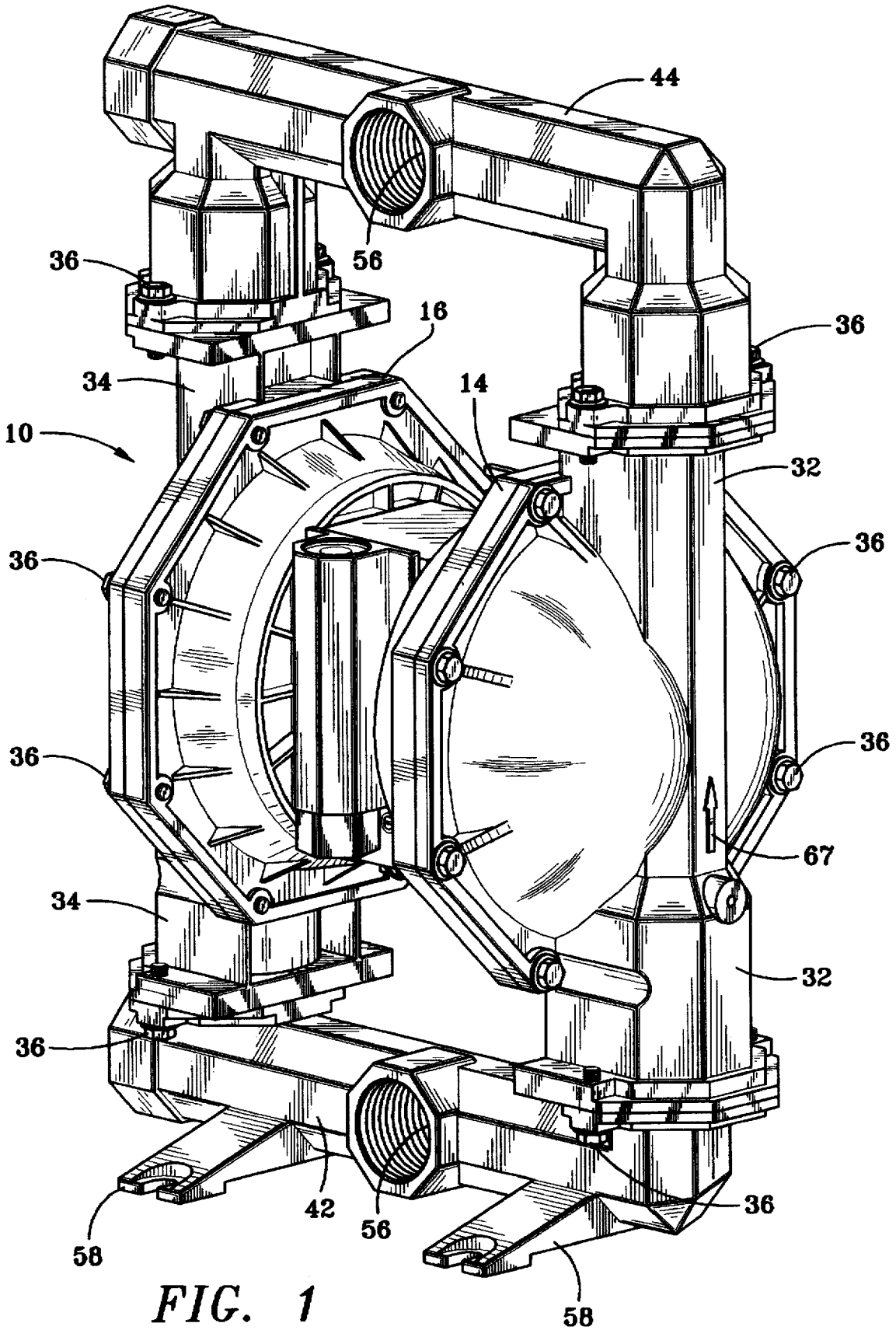
FIG. 1 is an isometric view of a first embodiment fluid pump which includes the improved flow manifolds of the present invention.

Turning now to the drawings wherein like parts are referred to by the same number throughout the several views, FIGS. 1–5 disclose a first embodiment fluid pump generally referred to at 10. The first embodiment fluid pump is a double diaphragm pump with ball-type check valves which check the flow of fluid through the pump. The pump 10 operates in a manner that is well known to one skilled in the art.

First embodiment diaphragm pump 10 includes a main pump housing 12 that supports a conventional pneumatic valve assembly (not shown) and first a second pressure chamber caps 14 and 16 which define first and second housing sides 15 and 17.

The valve assembly is of conventional design well known to one skilled in the art and as a result does not need to be described in detail. A pressurized gas, such as air, is supplied to the valve assembly to drive shaft 18 linearly in a reciprocating manner back and forth along axis 20. The shaft 18 extends through the housing so that one end of the shaft is located within the first pressure chamber cap 14 and the other end is located within the second pressure chamber cap 16.

Figure 2:
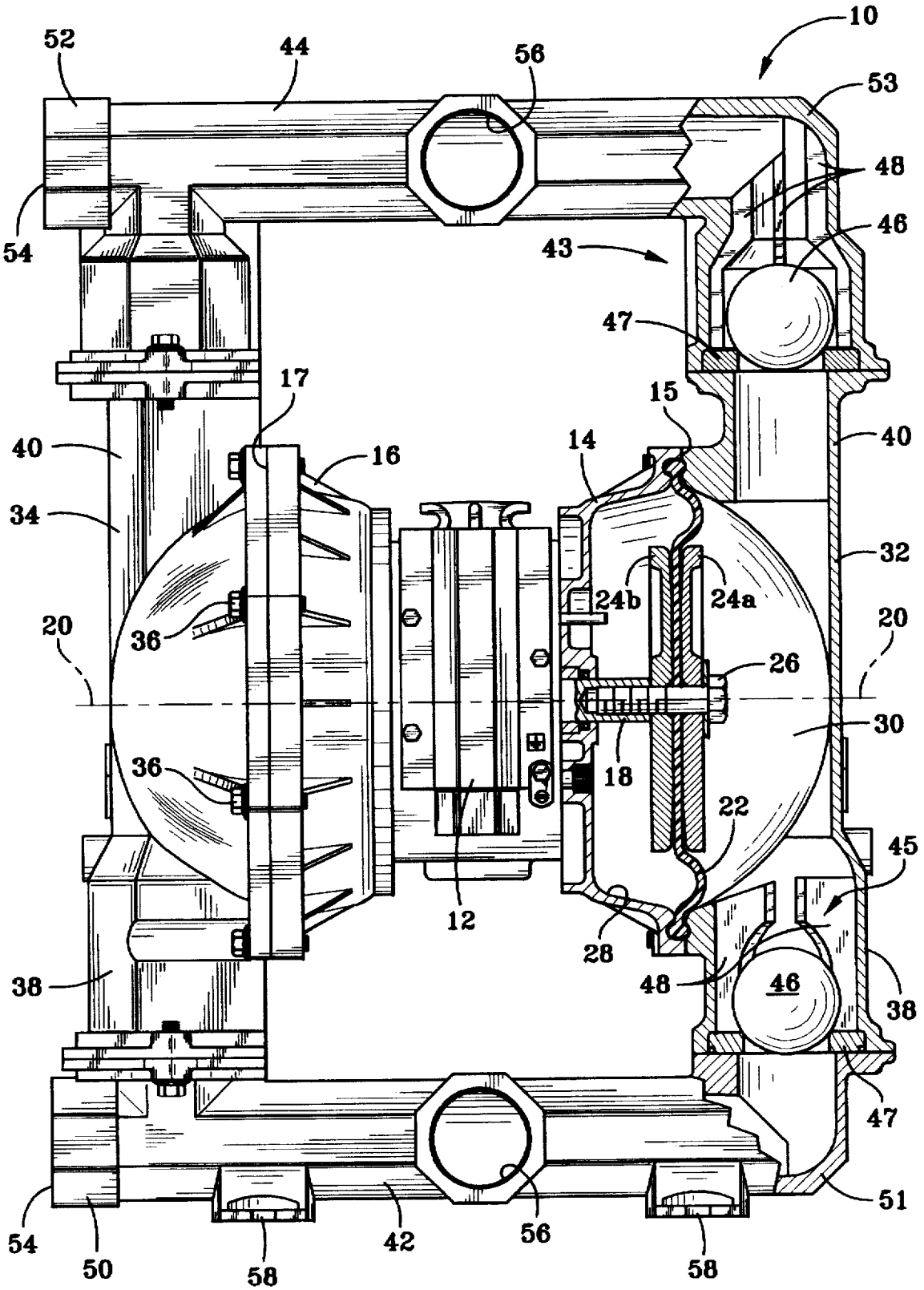
FIG. 2 is a front, partially sectioned elevation view of the first embodiment fluid pump of FIG. 1.

Referring now to the partially sectioned front view shown in FIG. 2, flexible diaphragm 22 is fixedly located at the end of shaft 18 located in pressure chamber cap 14. The center portion of the diaphragm 22 is sandwiched between two plates 24a and 24b which are connected to the end of shaft 18 by a conventional fastener 26. In this way, the center portion of the diaphragm moves with the shaft and plates. It should be understood that although it is not shown in FIG. 2, a diaphragm member like diaphragm, 22, with a center portion sandwiched between a pair of plates like plates 24a, and 24b is fixedly located at the opposite end of shaft 18 located in pressure chamber cap 16.

The left side of the pump 10 is structurally a mirror image of the right side of the pump and includes all of the elements that are included in the pump right side, so that as the description proceeds, only the right side of the pump will be described.

The outer periphery of diaphragm 22 is sandwiched between the first side 15 of main pump housing 12 and side manifold 32. Manifold 34, like manifold 32 is located along the second side of the pump 10. The first and second side manifolds are unitary and are adapted to be made integral with the main pump housing by conventional fasteners 36 such as bolts.

The diaphragm 22 and first fluid cap 14 define a pressure chamber 28 and the diaphragm 22 and first unitary side manifold 32 define a fluid chamber 30. During operation of pump 10, gas is flowed into and exhausted from the right and left pressure chambers to intermittently expand and collapse the diaphragms. Referring to FIG. 2, when gas is flowed into either pressure chamber and the respective diaphragm is expanded towards the respective unitary side manifold, the fluid in the adjacent fluid chamber is discharged from the fluid chamber. Conversely, as gas is flowed out of either pressure chamber the respective diaphragm is collapsed towards the respective pressure chamber cap, and fluid to be pumped is flowed into the adjacent fluid cheer.

Each manifold 32 and 34 includes an inlet end 38 and a discharge end 40.

An inlet manifold 42 is flow connected to the side manifolds at the inlet ends and a discharge manifold 44 is flow connected to the side manifolds 32 and 34 at the discharge ends thereof. See FIG. 1. The inlet and discharge manifolds are made integral with the side manifolds by conventional fasteners 36 which are preferably the same fasteners as previously described for making manifolds 32 and 34 integral with pressure chamber caps 14 and 16. By using the same fasteners, the assembly of pump 10 is greatly simplified.

The inlet ends of unitary first and second side manifolds 32 and 34 are wider than the manifold discharge ends and in this way are adapted to include conventional ball-type check valve 45. As shown in FIG. 2, means 48, for limiting the displacement of ball 46 off ball valve seat 47, is provided along the interior of the inlet ends. The ball valve seat 47 is located in a groove formed at the inlet end and the valve seat is located between the side manifold and inlet manifold 42 when the pump is assembled.

An indicia 67 is provided on each unitary side manifold. The indicia serves as a visible indicator to the pump operator of the direction that the fluid is conveyed through the pump.

One of the benefits associated with the unitary side manifolds 32 and 34 of the present invention is that either manifold may be flow connected to either the first or second side of housing 12 during the assembly operation. This flexibility in assembly along with the unitary design of the side manifolds and use of a single type of fastener to make component parts integral, greatly simplifies assembly of pump 10.

Figure 3:
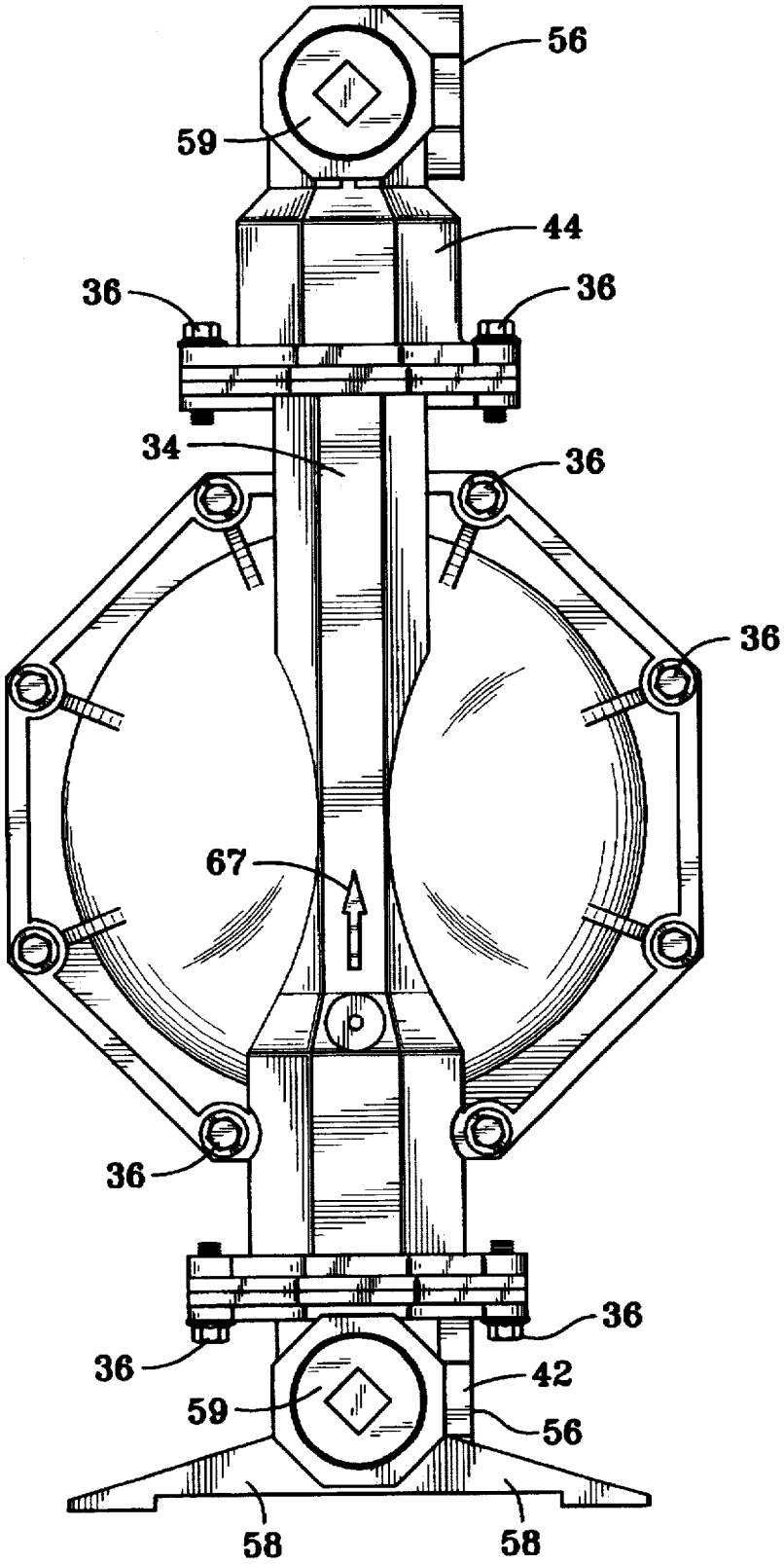
FIG. 3 is a left side elevation view of the fluid pump of FIG. 1.
Figure 4:
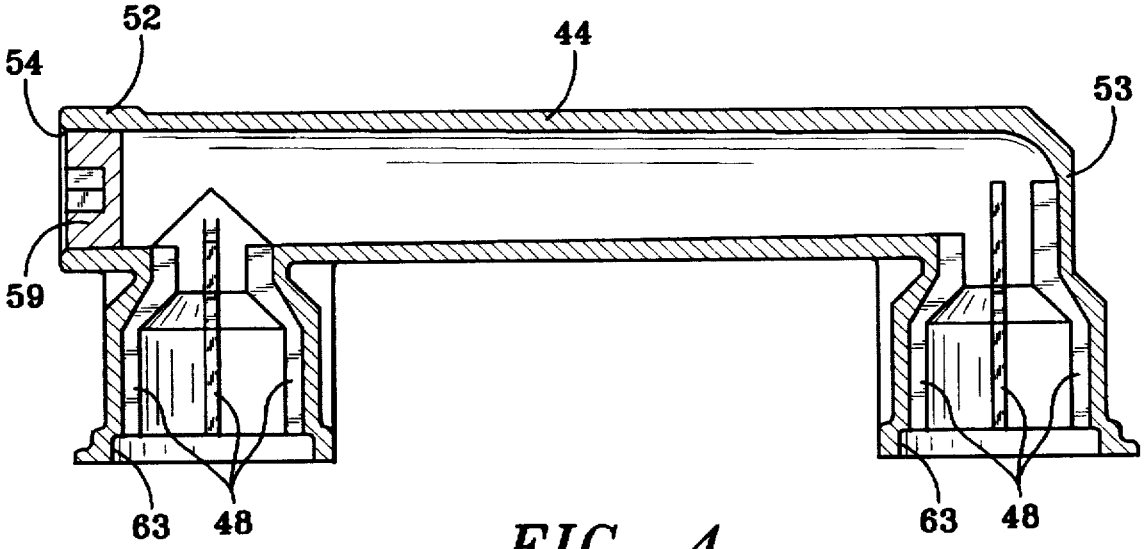
FIG. 4 is a longitudinal sectional view of the discharge manifold of the fluid pump of FIG. 1.
Figure 5:
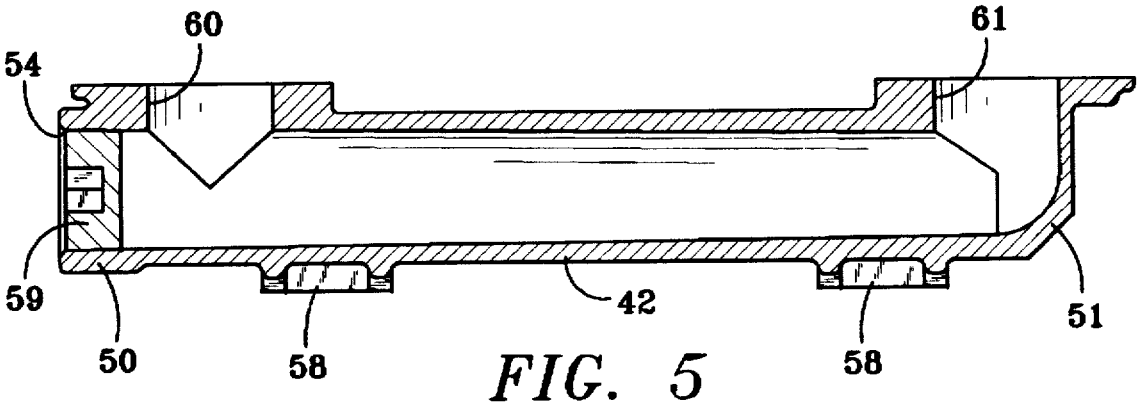
FIG. 5 is a longitudinal sectional view of the inlet manifold of the fluid pump of FIG. 1.

Inlet manifolds 42 and 44 respectively each have a first end and a second manifold end, identified in FIGS. 4 and 5 respectively as 50 and 51, and 52 and 53. The inlet and discharge manifolds each are provided with two ports for conveniently flow connecting the respective manifold to fluid flow lines. One port 54 is located at the first end of each manifold, and a second port 56 is located along the length of each manifold, between the manifold ends. Each port 56 is substantially equidistant from the manifold ends. Although two ports are provided in each manifold, it should be understood that any suitable number of ports may be provided in the inlet and discharge manifolds. The two ports 54 and 56 are oriented 90 degrees apart. The first port 54 opens towards the left side of the pump as shown in left side view, FIG. 3, and port 56 opening towards the front of the pump as shown in the front view of FIG. 2.

A cap 59 may be used to close the port that is not flow connected to a fluid flow line. The cap may be removably and threadably connected to the unused port. In FIG. 3, the caps 59 close first port 54 in both the inlet and discharge manifolds. The ports 54 in the inlet and discharge manifolds are shown along the same side of the pump 10 however the ports 54 may be located along different pump sides. For example, the port 54 on the inlet manifold may be located along the first pump side and the port 54 along the discharge manifold may be located along the second pump side.

Inlet manifold 42 includes flow openings 60 and 61 which are adapted to be flow connected to the inlet end 38 of side manifolds 32 and 34 respectively. The flow openings are directed away from the manifold 42, perpendicular to the manifold body. The manifold 42 is connected to the side manifolds 32 and 34 by fasteners 36.

The inlet manifold includes a pair of spaced apart feet 58 located proximate the ends 50 and 51 of the inlet manifold. The feet are adapted to support the pump 10 and are provided in order to fix the pump to a shop floor or any other suitable anchor surface.

Manifold 44 includes flow openings 63 and 62 which are directed away from the manifold body 44, perpendicular thereto. Ball type check valves 43, like the check valves 45 provided in the flow openings 63 and 62 and include a means 48 for limiting the travel of ball 46 off valve seat 47. The means 48 is formed along the wall of the flow openings. The valve seat 47 is located in a groove formed at the end of flow openings 62 and 63 provided and is held in place between the housing and respective side manifold when the discharge manifold is connected to side manifolds.

Figure 6:
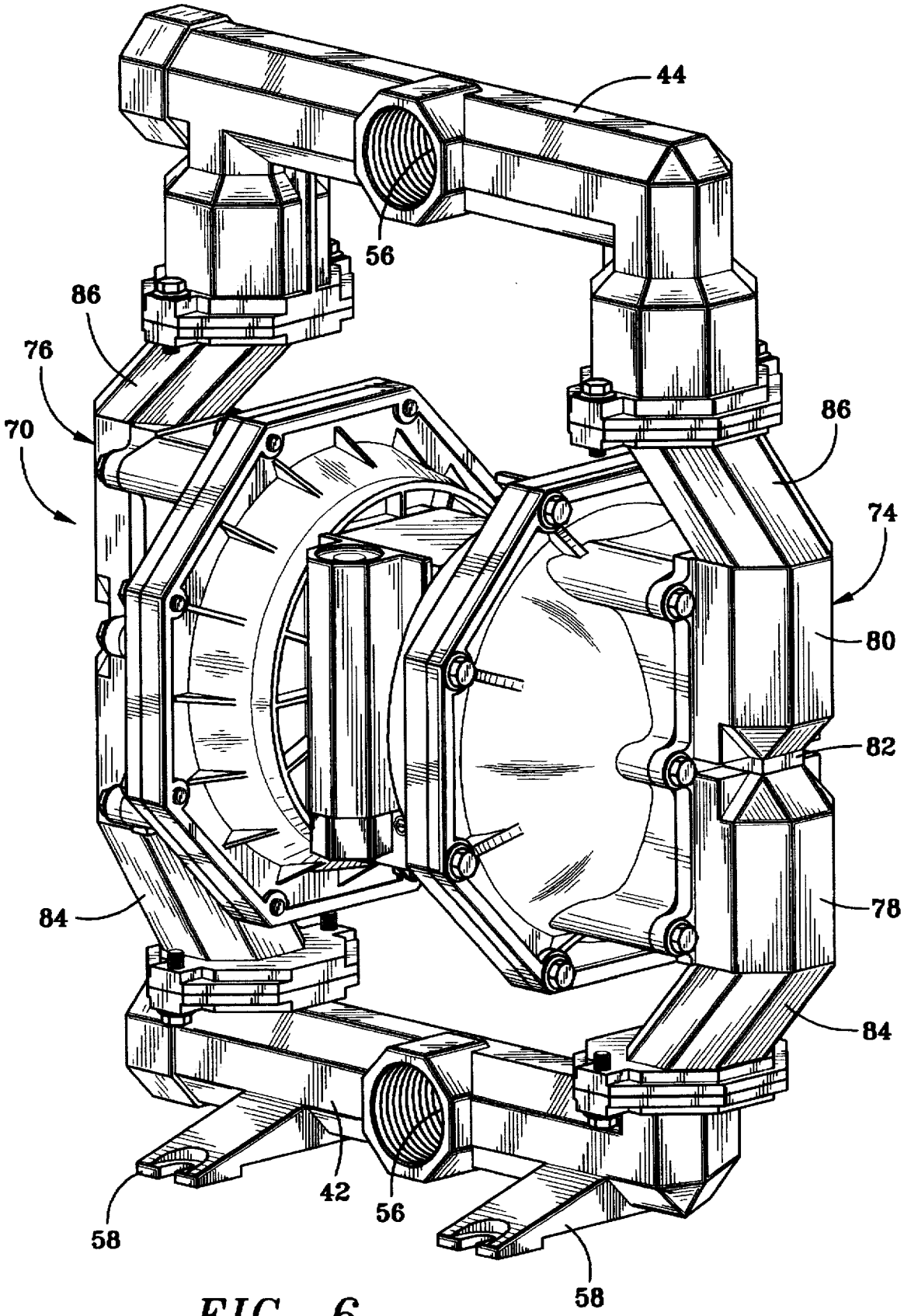
FIG. 6 is an isometric view of a second embodiment fluid pump which includes the improved flow manifolds of the present invention.
Figure 7:
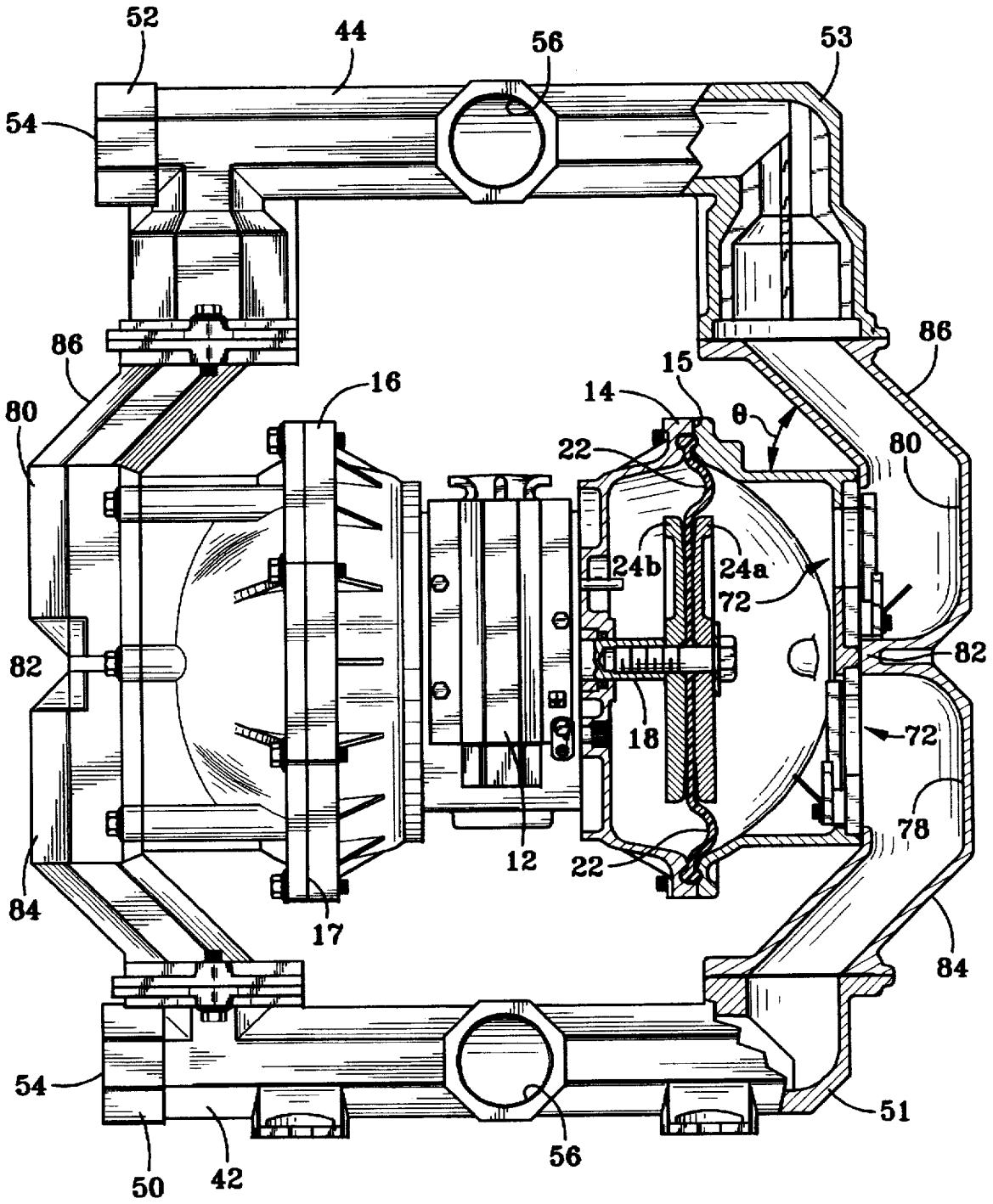
FIG. 7 is a front, partially sectioned elevation view of the second embodiment fluid pump of FIG. 6.
Figure 8:
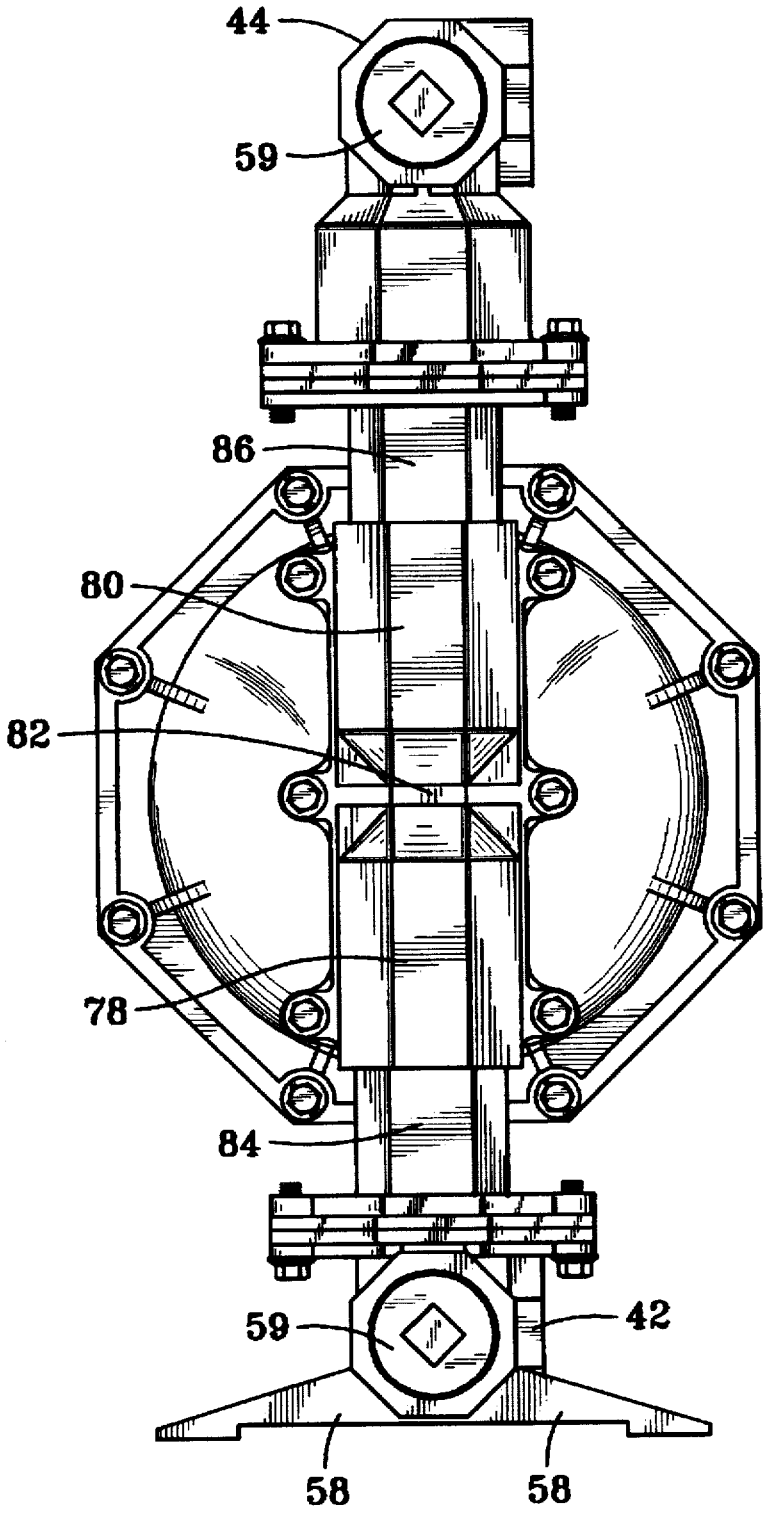
FIG. 8 is a left side elevation view of the second embodiment fluid pump of FIG. 6.

FIGS. 6–8 disclose a second embodiment fluid pump generally referred to at 70. Pump 70 is a diaphragm pump like pump 10 and includes substantially all of the elements previously described in the description of pump 10 except for manifolds 32 and 34 and the ball type check valves 43 and 45. The second embodiment pump is a double diaphragm pump which includes flap-type check valves 72 and first and second unitary side manifolds 74 and 76.

The flap valves are of conventional design and are held in place between the unitary side manifold and pump housing when the housing and manifolds are mated. The flap check valves are well known to one skilled in the art and thus further description thereof is not required.

The inlet ball checks 46 and valve seats 47 are removed from discharge manifold 44 and the inlet and discharge manifolds 42 and 44 are flow connected to the first and second side manifolds 74 and 76. Thus the improved inlet and discharge manifolds may be used for diaphragm pumps with either flap type or ball type check valves.

Each side manifold 74 and 76 includes an inlet portion, 78, a discharge portion 80, and a partition 82 separating the discharge and inlet portions. The manifolds each include inwardly directed connection portions 84 and 86 which serve to flow connect the inlet and discharge manifolds 42 and 44 to the side manifolds as shown in FIG. 7. The connection portions are directed inwardly towards pump housing 12. As shown in FIG. 7, the portions 84 and 86 are directed inwardly at an angle identified as θ, equal to approximately 45 degrees. However, it should be understood that the portions 84 and 86 may be directed inwardly at any suitable angle.

The side manifolds 74 and 76 are unitary and like side manifolds 32 and 34 are adapted to be used on either side of the pump 70 to simplify the assembly process. The manifolds 74 and 76 are designed to be interchangeable and do not have an associated specific location or orientation on pump 70. Additionally a single type of fastener 36 is used to make the component parts of pump 70 integral. In this way, a normally complex assembly operation is simplified.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A diaphragm pump comprising: a pump housing having a first housing side and a second housing side; a first unitary manifold flow connected to the first housing side; a second unitary manifold flow connected to the second side, said first and second unitary manifolds adapted to be flow connected to either the first and second housing sides; a pump inlet manifold; and a pump discharge manifold, said pump inlet and discharge manifolds each having a first end, a second end, a first flow port provided at one of the ends and a second flow port located along the respective manifold between the manifold ends, the inlet and discharge manifolds adapted to be flow connected to said first and second unitary manifolds.

2. The diaphragm pump as claimed in claim 1, wherein the first and second unitary manifolds include a first portion having a first unitary manifold end and a second unitary manifold end, a first flow connection portion extending away from the first unitary manifold end, and a second flow connection portion extending away from the second unitary manifold end, said first and second connection portions directed inwardly towards the pump housing when the unitary manifolds are flow connected to the housing.

3. The diaphragm pump as claimed in claim 1 wherein the diaphragm pump includes at least one ball-type check valve.

4. The diaphragm pump as claimed in claim 1 wherein the diaphragm pump includes at least one flap-type check valve.

5. The diaphragm pump as claimed in claim 1 wherein the port located between the ends of the inlet and discharge manifolds is located substantially equidistantly from the two manifold ends.

6. The diaphragm pump as claimed in claim 2 wherein each unitary manifold defines a flow chamber that is separated into an inlet portion and a discharge portion by a partition.

7. A diaphragm pump comprising: pump housing having a first housing side and a second housing side; a first unitary manifold flow connected to the first housing side; a second unitary manifold flow connected to the second side, said first and second unitary manifolds adapted to be flow connected to either the first and second housing sides; a pump inlet manifold; and a pump discharge manifold, said pump inlet and discharge manifolds each having at least two flow ports provided along the length of each manifold, the inlet and discharge manifolds adapted to be flow connected to said first and second unitary manifolds.

8. The diaphragm pump as claimed in claim 7 wherein the first and second unitary manifolds include a first portion having a first unitary manifold end and a second unitary manifold end, a first flow connection portion extending away from the first unitary manifold end, and a second flow connection portion extending away from the second unitary manifold end, said first and second connection portions directed inwardly towards the pump housing when the unitary manifolds are flow connected to the housing.

* * * * *